United States Patent [19]

Hughes

[11] Patent Number: 4,975,982

[45] Date of Patent: Dec. 11, 1990

[54] TURTLENECK BIB

[76] Inventor: Linda B. Hughes, 1631 Rugby Rd., Schenectady, N.Y. 12309

[21] Appl. No.: 353,257

[22] Filed: May 16, 1989

[51] Int. Cl.[5] ..... A41B 13/10

[52] U.S. Cl. ..... 2/49 R; 2/91; 2/174

[58] Field of Search ..... 2/49 R, 50, 51, 60, 2/80, 75, 90, 91, 102, 103, 106, 107, 112, 116, 174, 91; D2/44; 66/176

[56] References Cited

U.S. PATENT DOCUMENTS

| | | | |
|---|---|---|---|
| 783,867 | 2/1905 | Hyman | 2/91 |
| 1,199,813 | 10/1916 | Ogborn | 2/90 |
| 2,289,526 | 4/1939 | Tapper | 2/50 |
| 2,364,568 | 6/1942 | Tiscornia | 2/50 |
| 2,809,375 | 10/1957 | Doron | 2/91 |
| 2,857,599 | 10/1958 | Wallace | 2/49 R |
| 3,067,428 | 10/1958 | Baker et al. | 2/52 |
| 3,099,013 | 7/1963 | Thorpe | 2/103 |
| 3,155,985 | 11/1964 | Gallagher | 2/103 X |
| 3,158,872 | 12/1964 | Pantzke | 2/103 X |
| 3,230,547 | 1/1966 | Moran | 2/119 |
| 3,449,766 | 6/1969 | Garber et al. | 2/90 X |
| 3,823,417 | 7/1974 | Cluckey | 2/91 |
| 3,979,776 | 9/1976 | Gruenwald | 2/49 R |
| 4,038,697 | 8/1977 | Levitt | 2/49 |
| 4,442,552 | 4/1984 | Bolick et al. | 2/49 R |
| 4,458,364 | 7/1984 | Fenninger et al. | 2/50 |
| 4,495,660 | 1/1985 | Hayden | 2/91 |
| 4,646,365 | 3/1987 | Surprise et al. | 2/49 R |
| 4,706,303 | 11/1987 | Van Gompel et al. | 2/49 R |
| 4,718,123 | 1/1988 | Petropoulos | 2/91 |
| 4,719,650 | 1/1988 | Milloy | 2/49 R |
| 4,780,911 | 11/1988 | Mack | 2/49 R |
| 4,780,912 | 11/1988 | Harmsen | 2/90 X |
| 4,787,099 | 11/1988 | Mack | 2/49 R |

OTHER PUBLICATIONS

JC Penney Fall and Winter Catalog, 1975, pp. 632 and 90.

*Primary Examiner*—Werner H. Schroeder
*Assistant Examiner*—Jeanette E. Chapman
*Attorney, Agent, or Firm*—Schmeiser, Morelle & Watts

[57] ABSTRACT

A turtleneck bib having an elongated collar portion which is secured to the shield portion of the bib. The height of the collar is at least 4 inches and the inner circumference of the collar is at least 11 inches to encourage non-restrictive folds which contact the child's neck and prevent liquids from traveling under the collar. A horizontal pleat on the collar encourages the formation of the nonrestrictive folds.

6 Claims, 1 Drawing Sheet

TURTLENECK BIB

FIELD OF THE INVENTION

Generally, this invention relates to shields that are worn about a person for protecting the individuals clothing. More specifically, this invention is an improved bib having a protective turtleneck collar in combination with a front shield which extends over the child's clothing.

BACKGROUND OF THE INVENTION

Presently, there are numerous shields available which serve as protective coverings for a variety of items; including clothing, furniture and other easily soiled materials. One of the most common of such coverings is a bib, and more particularly, a bib of the type which is commonly used when feeding a child. Bibs such as these come with a variety of features in order to meet the various difficulties normally encountered when feeding a child, and also to satisfy the individual preferences of the parents.

Thus, one may easily find bibs which are disposable, or made out of plastic, which also may have a food catch to receive and collect fallen foods and liquids. The ways of attaching these bibs are almost equally as numerous, some use the well known tie strings while others use adhesive materials, such as velcro, and still others utilize elasticized neck bands. Furthermore, bibs come in a variety of shapes and sizes, and are frequently combined with related items such as pacifier attachments or bottle holders.

Nevertheless, with all of the consideration which has been given to children's bibs, one particular requirement has not been satisfactorily met. Namely, the need to attach the bib in such a way that there is no constriction about the child's neck, yet have an attachment which is sufficient to prevent liquids and food products from traveling down the child's neck, under the bib, and thereby staining the clothing thereunder.

Attempts to overcome this problem have taken myriad forms. Adhesive fasteners, series of interlocking catches, and even standard tie strings all see the solution to this problem in the need to be able to draw the attachment tightly about the child's neck. This approach however, fails in two respects. First, to be certain that one has prevented any space between the bib and the child's neck, the attachment must be uncomfortably tight for the child. Secondly, due to the general activity of children, many of these attachments loosen during use, which loosening is exacerbated when the child plays with or pulls on the shield portion of the bib.

Another approach to prevent food from moving down the child's neck, is to utilize an elastic neck band. Where such neck bands are not adjustable, it will be found that one size will be to tight for larger children and yet to large for smaller children. Even with an adjustable neck band, the need to draw the neck band tightly about the child's neck will be overly constricting and uncomfortable.

A more serious concern in this area is the ease of detaching the bib for safety purposes. Many parents avoid tie string bibs out of a fear that the child may somehow catch the bib on some typical household item and then fall; which if the bib does not release will likely to cause injury or even death. To avoid this, it is common to have a bib which will detach when an excess amount of pressure is applied to the bib. However, with use, attachments such as these, which initially remain secured during normal feeding, become weak or worn, in which case the child can readily remove the bib simply by pulling on it.

For these reasons, the bibs presently available do not sufficiently solve the problem of either restrictive or ineffective neck bands. It was to overcome these various problems that the subject invention was developed.

SUMMARY OF THE INVENTION

The subject invention utilizes a passive barrier to prevent food or liquid from traveling down the child's neck. This is accomplished by providing an array of potential barrier points which, although often influx as the child moves, retain comfortable contact with the child's neck. This comfortable, or passive contact, is the result of an excessive material in the form of an overly high and wide turtleneck collar. With a 13" circumferential opening, the collar is virtually assured of being loose on any child. However, even a small child obtains the same protective results since the exaggerated height, which is preferably 6", of the turtleneck, results in a bunching affect and concomitant neck/collar contact at various points. Even where a passageway may exist beneath the collar, such a passageway will not be in a straight line due to the non-vertical folds which occur naturally in the oversized turtleneck. These factors, combined with the use of an absorbent elastic material for the turtleneck, result in the absorption of any liquids or soft food products running down the child's neck. It should be noted that the elasticity of the turtleneck is simply for convenience in applying the bib over the child's head, and has virtually no restrictive effect when the turtleneck is in place.

Also, one or two small horizontal pleats on the back of the turtleneck serve to encourage horizontal folds in the front portion of the turtleneck. These pleats only gather approximately one half inch of material and are only one and half inches long. Therefore, they do not significantly reduce the collar circumference in the horizontal plane in which they are located but simply encourage the creation of folds.

Due to the height of the collar, the upper portion extends outward from the neck beneath the child's mouth and travels toward the chin. Thus, any downward motion of the chin tends to urge the collar downwardly, multiplying the collars tendency to form non-vertical folds or corrugations. Also, as the upper portion of the collar extends from a vertical orientation to a horizontal one, liquids traveling down the chin and towards the neck will, due to gravity, be drawn into contact with the absorbent collar.

Due to the size and elasticity of the turtleneck, should a child pull on the shield portion of the bib, the movement of the front lower portion of the turtleneck away from the neck will tend to move the front upper portion of the turtleneck into increased contact with the child's neck and thus a vertical passageway will still not be created. Of course, pulling on the shield will not cause the bib to become disengaged since the turtleneck encompasses the entire neck.

It should also be appreciated that this invention may be used with protective shield portions of any present bib. Therefore, shields made of cloth, plastic, cloth backed with plastic, shields with catches, or those with combined features may be used with the subject invention.

The subject invention also provides greater safety for the child. Because of the size of the turtleneck, should the child somehow catch the bib and then fall, the pressure from the child's weight would be at least partially distributed over the length of the collar. This distribution will have less of a tendency to strangle the child, since all the pressure is not applied to a relatively thin line which would be more likely to restrict the child's windpipe.

A modified turtleneck may also be incorporated into the subject invention. This modification would place a vertical opening down the rear portion of the collar in order to allow the collar to be attached without being placed over the child's head. Any suitable attachment means, such as snaps, tie strings, velcro-type fasteners and the like could be used to secure the turtleneck in place. Otherwise, the turtleneck would function in precisely the same manner as already described.

DETAILED DESCRIPTION OF THE DRAWINGS

Figure 1:
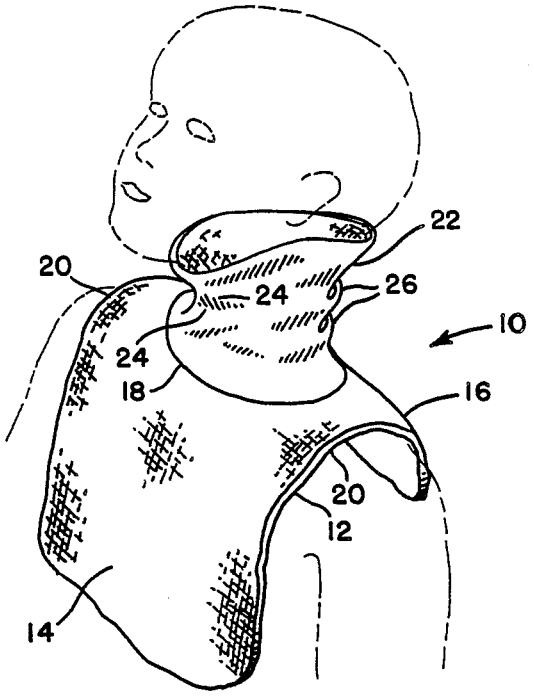
FIG. 1 is a perspective view of the invention.

FIG. 1 discloses the bib which is generally designated as 10. The bib 10 has a shield 12 which is adapted to extend over the users shoulders. The shield has a front portion 14 and rear portion 16. A circumferential opening 18 is centered relative to the sides 20 of the shield 12 but is located such that when placed in its operative position, the rear portion 16 does not extend as far down the users back as the front portion 14 extends down the front of the user. Because the shield extends over the shoulders, greater protection is provided to the child's underclothing, since it is not uncommon for children to turn their head and display a significant amount of movement when eating. About the perimeter of the opening 18 is secured, at one of its axial ends, an elongate tubular turtleneck collar 22. The collar 22 is of like diameter to the opening 18. In my preferred embodiment, the shield is made of cloth and the turtleneck is made of an elasticized material for easy application and removal. Nevertheless, the shield could be made of a nonabsorbent material such as plastic, or a combination of plastic backed with cloth. In addition, any number of variations may be considered since the subject of this invention is not limited or in any way altered by the shield portion.

The collar 22, has an opening which is between 11 and 15 inches with 13 inches being the preferred size. The height of the collar is at least 4 inches and in the preferred embodiment it is 6 inches. Thus the collar, due to exaggerated height, tends to form non-vertical folds or corrugations 24.

Figure 2:
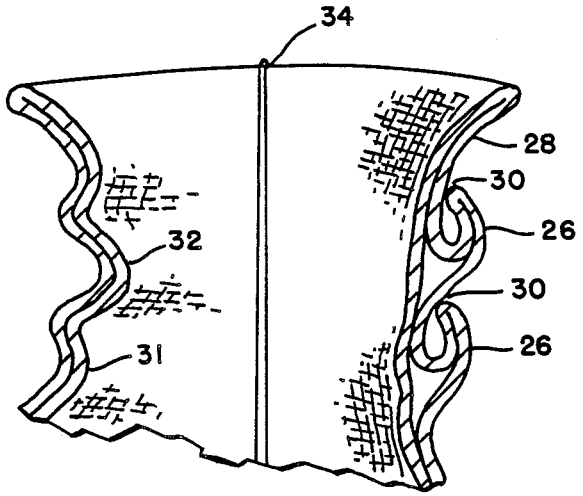
FIG. 2 is a cross sectional view.

At the back of the collar 22, is a pleat 26 which is substantially transverse to the elongated axis of the collar. As shown more clearly in FIG. 2, the collar in the preferred embodiment is made of a 2 ply material. A portion, generally no more than ½ inch of the material of the outside ply 28 is gathered, folded upward, and sewn at 30, thus forming the pleat 26. The pleat 26 encourages a corrugation across the front of the collar at 32, since the circumference at the pleat is now slightly limited. It should be noted that this narrowing or lessening of the circumference is not sufficient to cause tightness around a child's neck, but is simply to encourage the folds which will lay gently against the child's neck during use. The upward fold assists in maintaining the corrugation, since the excess material within the fold extends downwardly and its position is reinforced during normal wearing of the bib. It should also be noted, that if preferred, two pleats may be used as shown in FIG. 2, which further encourages folding or corrugations. Since these pleats do not lie in the same horizontal plane, there is no compound limiting of the circumference of the opening and therefor the use of two pleats is no more restrictive to the child than one pleat would be.

In an alternate embodiment as shown in FIG. 2 there may be a vertical slit 34 which is movable between a secured closed position and an open position. The slit may extend across the shoulder portion of the shield, or if only a front shield is used the slit may extend to the bottom of the collar where there is no shield so as to enable the user to place the shield about the child without placing it over the child's head. The means for securing the collar together at slit 34 may be by snaps, a zipper, or adhesive materials such as that sold under the trademark Velcro.

While the above describes the preferred embodiment of the Invention it should be appreciated that many variations may be made within the actual teaching of this invention. Therefore, it is intended that the scope of the invention be limited only by the appended claims.

I claim:

1. A turtleneck-bib combination for protecting a child's clothes during feeding comprising:

a shield portion adapted to extend at least over the child's chest;

a turtleneck portion having an expansible tubular collar elongated along an axis for loosely fitting around the child's neck, said collar being attached at its one axial end to said shield portion; and at least one pleat in said collar, which pleat is a fold made substantially transverse to the elongated axis of the collar by doubling the expansible collar over on itself and sewing it together.

2. The invention of claim 1 wherein the length of the collar along its elongated axis is at least 4 inches and the inner circumference of said tubular collar is at least 11 inches.

3. A turtleneck-bib combination for protecting a child's clothing during feeding comprising:

a shield portion made of a material for extending at least over the child's chest; and a turtleneck portion having an expansible, tubular collar elongated along an axis for loosely fitting around the child's neck and providing sufficient material for the formation of at least one horizontal fold in said collar, said collar being attached at its one axial end to said shield portion;

nonvertical folds forming secondary food catching means located on the turtleneck portion of the bib, whereby when said bib is placed on a child prior to feeding, said secondary food catching means extend outwardly from the neck region and functions to catch and hold any food which drips onto said turtleneck portion; and said turtleneck portion having means for encouraging and maintaining said nonvertical folds in said turtleneck; and for sealing portions of an inner circumference surface of the turtleneck against the child's neck when said device is placed on said child whereby any food that drips onto the interior surface of the neck portion is completely prevented from running downwardly.

4. The invention of claim 3 wherein said bib has a nonabsorbent shield portion to prevent liquids from soaking through said shield.

5. A turtleneck-bib combination for protecting a child's clothing during feeding comprising:

a shield portion made of a material for extending at least over the child's chest; and a turtleneck portion having an expansible, tubular collar elongated along an axis for loosely fitting around the child's neck and providing sufficient material for the formation of at least one horizontal fold in said collar, said collar being attached at its one axial end to said shield portion; and pleat means for encouraging and maintaining horizontal folds in said turtleneck, which pleat is a fold made substantially transverse to the elongated axis by doubling the expansible collar over on itself and sewing it together.

6. The invention of claim 5 further comprising:

a vertical slit in said turtleneck portion movable between a secured closed position and open position, in said open position said slit allowing the turtleneck to be placed around the child's neck without placing it over the child's head.

* * * * *